US005883562A

United States Patent [19]

Matsuoka et al.

[11] Patent Number: 5,883,562

[45] Date of Patent: Mar. 16, 1999

[54] AMORPHOUS RESIN ARC SUPPRESSION FUSE

[75] Inventors: Naoki Matsuoka; Kenji Muramatsu, both of Shizuoka, Japan

[73] Assignee: Yazaki Corporation, Tokyo, Japan

[21] Appl. No.: 954,087

[22] Filed: Oct. 20, 1997

[30] Foreign Application Priority Data

Oct. 18, 1996 [JP] Japan ..... 8-276627

[51] Int. Cl.[6] ..... H01H 85/38

[52] U.S. Cl. ..... 337/273; 337/227; 337/280; 337/290

[58] Field of Search ..... 337/270, 273, 337/279, 280, 287, 282, 290; 29/623; 438/215

[56] References Cited

U.S. PATENT DOCUMENTS 4,757,296 7/1988 Brown et al. ..... 337/276
5,148,140 9/1992 Goldstein ..... 337/158
5,420,560 5/1995 Hanada ..... 337/273
5,572,181 11/1996 Kiryu et al. ..... 337/273

*Primary Examiner*—Leo P. Picard
*Assistant Examiner*—Jayprakash N. Gandhi
*Attorney, Agent, or Firm*—Sughrue, Mion, Zinn, Macpeak & Seas PLLC

[57] ABSTRACT

There is disclosed an arcless fuse in which adverse effects on an equipment due to an arc discharge, produced when the fuse is melted, are prevented, and also melted metal is prevented from dissipating. An arcless fuse includes a fuse element 25 having opposite ends connected respectively to a pair of terminals 23 and 23, the fuse element being in the form of one of a wire and a strip. A part of the fuse element 25 intermediate the opposite ends thereof is formed into such a non-linear configuration that a plurality of portions are arranged in closely spaced relation to one another, and the fuse element 25 is molded in a housing 27 of a synthetic resin. Preferably, an amorphous resin is used as the synthetic resin molding the fuse element 25 therein.

3 Claims, 5 Drawing Sheets

AMORPHOUS RESIN ARC SUPPRESSION FUSE

BACKGROUND OF THE INVENTION

This invention relates to an arcless fuse which will not produce an arc discharge upon melting.

As shown in FIG. 1, a conventional fuse is formed by passing a linear fusible portion (fuse element) 1 through a glass tube 3 and then by connecting opposite ends of the fuse element 1 respectively to terminals (bases) 5 and 5 provided respectively at opposite ends of the glass tube 3. As shown in FIG. 2, another conventional fuse is formed by interconnecting a pair of blade-type male terminals 7 and 7 by a fuse element 1 and then by putting this portion into a housing 9 made of a synthetic resin.

In these fuses, when an overload current or a short-circuit current flows in a circuit as shown in FIG. 3(A), Joule heat J is generated in a localized portion of the fuse element 1 as shown in FIG. 3(B), and when the heat reaches a melting point, the fuse element is fused, and part of the fused portion is vaporized and dissipated as shown in FIG. 3(C). In the conventional fuse, at the time of this dissipation, an arc discharge was sometimes produced in a metal vapor 11 in the atmosphere, so that the current was not interrupted, but flowed. Thus, an arc discharge is almost always involved when the fuse is melted, and in the case of the low-voltage, small-current arc discharge, it fades away to natural extinction, and then the circuit is interrupted.

Although the conventional fuses are so designed that the circuit can be interrupted immediately after the fuse element 1 is melted and dissipated, the current continues to flow during the time when an arc discharge is produced as described above. Therefore, the circuit is not interrupted, so that the purpose of protection is not achieved, and besides there is a possibility that a malfunction is caused in a precision equipment, such as a computer, by an abrupt voltage change developing at the time of an arc discharge.

Furthermore, in the conventional fuses in which the fuse element 1 is dissipated, the glass tube or the housing may be broken, and in some cases this invites an undesirable situation.

SUMMARY OF THE INVENTION

The present invention has been made under the above circumstances, and an object of the invention is to provide an arcless fuse in which adverse effects on an equipment due to an arc discharge, produced when the fuse is melted, are prevented, and also melted metal is prevented from dissipating.

The above object of the invention has been achieved by an arcless fuse comprising a fuse element having opposite ends connected respectively to a pair of terminals, the fuse element being in the form of one of a wire and a strip;

wherein a part of the fuse element intermediate the opposite ends thereof is formed into such a non-linear configuration that a plurality of portions of the part are arranged in closely spaced relation to one another; and the fuse element is embedded in a housing by molding out of a synthetic resin.

Preferably, an amorphous resin is used as the synthetic resin.

In the above-mentioned construction, the housing may be provided with a cavity which is formed in the vicinity of the part of the fuse element.

Further, in the above-mentioned construction, the fuse element may be molded in such a manner that a tubular cavity is formed as a result of liquefaction of the fuse element when the fuse element is subjected to an excess current.

In the arcless fuse of this construction, when an excess current is produced, the fuse element is liquefied by Joule heat, and the liquefied fuse element is thermally expanded in a sealed tubular cavity formed in the housing as a result of liquefaction of the fuse element. At the same time, the housing is thermally decomposed by heat generated from the fuse element, thereby rapidly producing a large amount of gas, so that the pressure within the tubular cavity is increased by the metal gas and the thermal decomposition gas. At this time, if the plurality of portions of the fuse element are arranged in closely spaced relation to one another, the stress concentration develops, and a crack is formed in a portion of the inner surface of the tubular cavity on which the stress has concentrated, and the liquefied fuse element is injected into this crack. As a result of this injection, the amount of the liquefied, low-melting metal in the tubular cavity, and an interruption portion is formed in the tubular cavity, so that the electrical conduction of the fuse element is interrupted. At this time, an arc resistance is increased by the pressure effect and the change of the electrically-conductive gas into a lean state, and also the cooling effect is achieved, so that an arc discharge is interrupted.

In the arcless fuse having the housing made of the amorphous resin, the housing is softened without exhibiting a constant melting point, and therefore the crack remains in such a condition that it can be easily viewed.

DETAILED DESCRIPTION OF THE PREFERRED EMBODIMENTS

A preferred embodiment of an arcless fuse of the present invention will now be described in detail with reference to the drawings.

Figure 1:
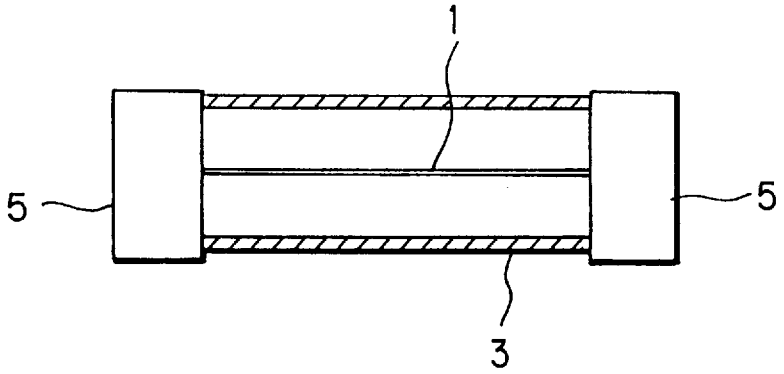
FIG. 1 PRIOR ART
FIG. 1 is a cross-sectional view of a conventional fuse of the glass tube-type.
Figure 2:
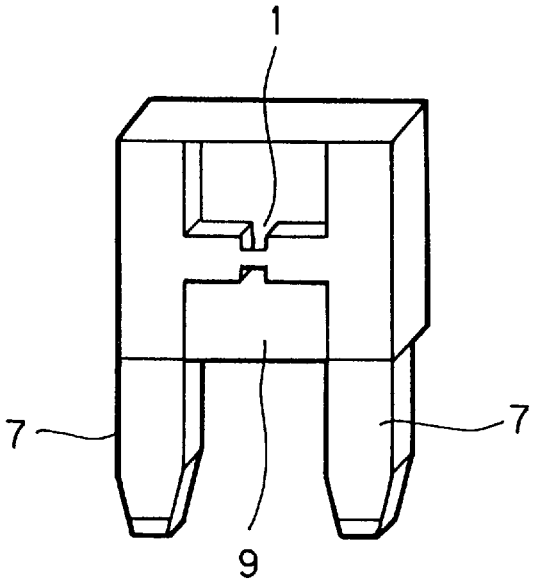
FIG. 2 PRIOR ART
FIG. 2 is a perspective view of a conventional blade-type fuse.
Figure 3A:
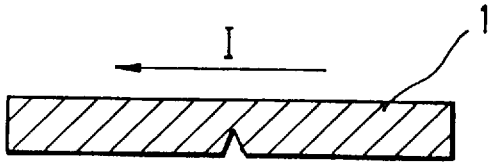
FIG. 3(A) PRIOR ART
FIG. 3(A)–3(C) are views showing the process of production of an arc discharge in the conventional fuse.
Figure 3B:
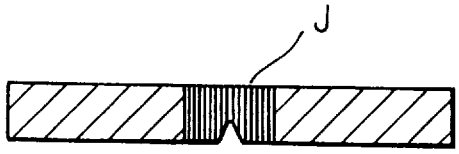
FIG. 3(B) PRIOR ART
Figure 3C:
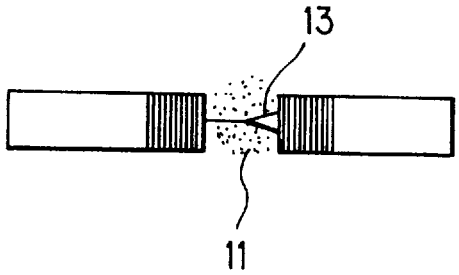
FIG. 3(C) PRIOR ART
Figure 4:
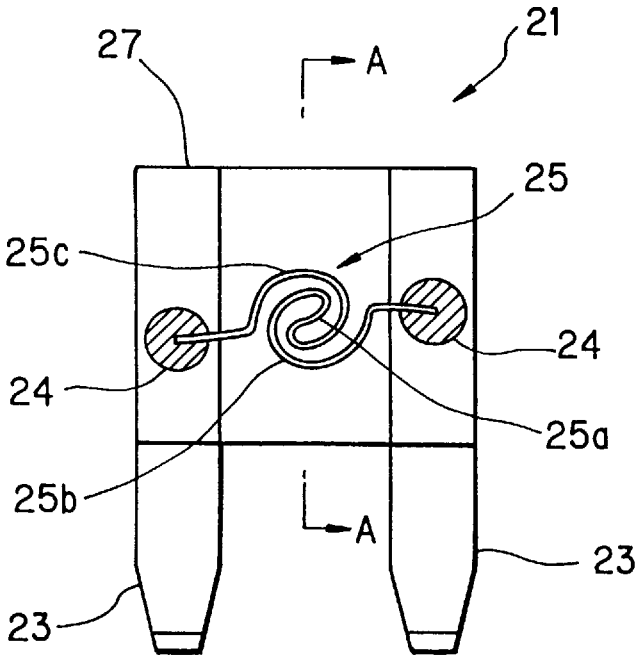
FIG. 4 is a front-elevational view of an arcless fuse of the present invention.
Figure 5A:
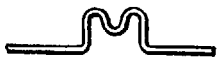
FIGS. 5(A) to 5(G) are views respectively showing suitable examples of shapes of fuse elements in the arcless fuse of the invention.
Figure 5B:
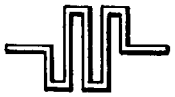
Figure 5C:
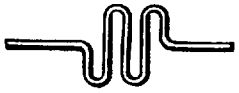
Figure 5D:
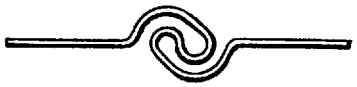
Figure 5E:
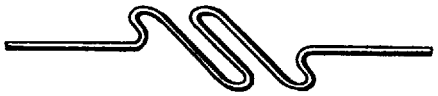
Figure 5F:
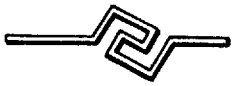
Figure 5G:
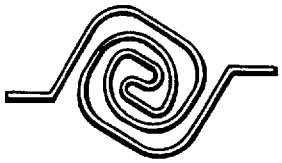
Figure 6:
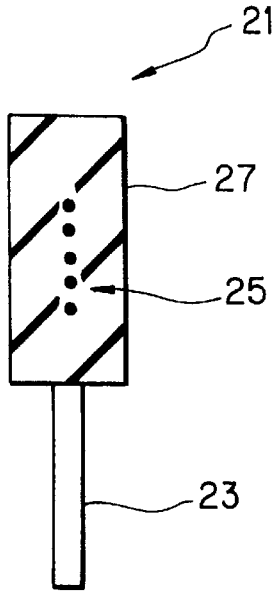
FIG. 6 is a cross-sectional view taken along the line A—A of FIG. 4.
Figure 7:
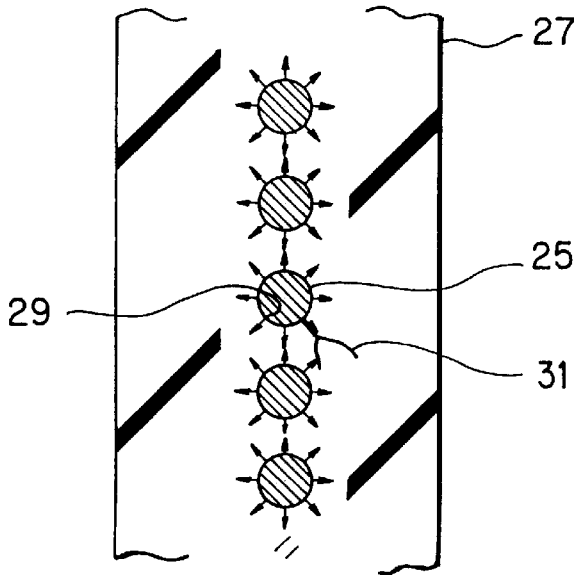
FIG. 7 is an enlarged view of an important portion of FIG. 6.
Figure 8:
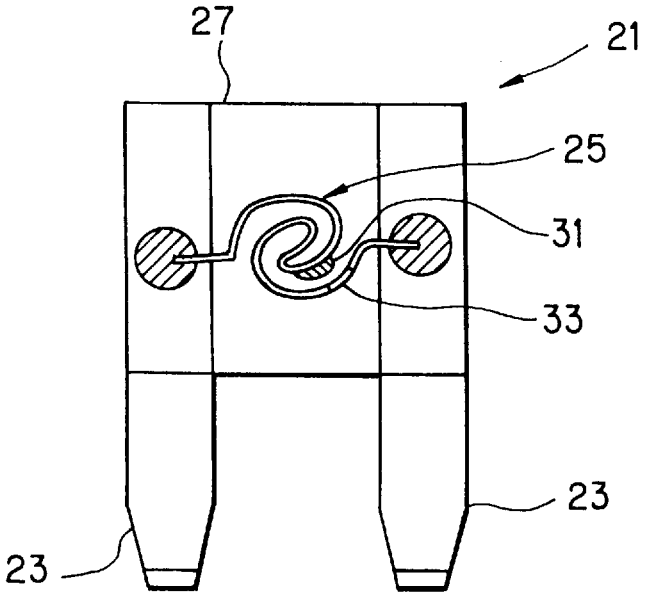
FIG. 8 is a front-elevational view of the arcless fuse of the invention, showing a melted condition thereof.

FIG. 4 is a front-elevational view of the arcless fuse of the invention, FIGS. 5(A) to 5(G) are views respectively showing suitable examples of shapes of fuse elements in the arcless fuse of the invention, FIG. 6 is a cross-sectional view taken along the line A—A of FIG. 4, FIG. 7 is an enlarged view of an important portion of FIG. 6, and FIG. 8 is a front-elevational view of the arcless fuse of the invention, showing a melted condition thereof.

The arcless fuse 21 is formed by interconnecting a pair of terminals (blade-type male terminals) 23 and 23 by a fuse element 25 and then by molding this portion in a housing 27 of a synthetic resin.

The fuse element 25 is made of low-melting metal which a metal has a melting point at low temperature, and is in the form of a wire or a strip. Opposite ends of the fuse element 25 are connected respectively to the terminals 23 and 23 by brazing, press-fitting, or riveting, thereby forming a fuse circuit. A central portion of the fuse element 25, connected at its opposite ends to the terminals 23 and 23, is formed into such a non-linear configuration that a plurality of portions of this central portion are arranged in closely spaced relation to one another. More specifically, in the fuse element 25 of this embodiment, an upper end of a reversed S-shaped portion 25*a* is connected to a C-shaped portion 25*b* while a lower end thereof is connected to a reversed C-shaped portion 25*c*, and therefore the central portion of the fuse element 25 is formed into a generally vortex shape.

This non-linear configuration may be formed in a plane, or may be formed in a three-dimensional manner. Examples of configuration, formed in a plane, include the configuration shown in FIG. 4, an M-shaped configuration of FIG. 5(A), a configuration of FIG. 5(B) defined by channel-shaped portions and inverted channel-shaped portions alternately connected together, a configuration of FIG. 5(C) defined by U-shaped portions and inverted U-shaped portions alternately connected together, a configuration of FIG. 5(D) defined by a C-shaped portion and an inverted C-shaped portion connected together, a configuration of FIG. 5(E) obtained by tilting the configuration of FIG. 5(C), a configuration of FIG. 5(F) defined by hooks obtained by modifying the configuration of FIG. 5(D), and a configuration of FIG. 5(G) defined by two vortexes connected together. One example of three-dimensional configuration is a spiral coil-shape (not shown).

As described above, the fuse element 25 and part of the terminals 23 and 23 are molded in the housing 27 of a synthetic resin. An amorphous solid is used as this synthetic resin. In an amorphous solid, regularity in the arrangement of the atoms and ions is hardly observed, and the amorphous solid does not exhibit a constant melting point, and is liquefied after a softened condition. For example, an epoxy resin can be used as the amorphous solid forming the housing 27.

As shown in FIG. 6, when the arcless fuse 21 of this embodiment is seen along the line A—A of FIG. 4, five cross-sections of the fuse element 25, embedded in the housing 27, are vertically arranged in proximity to one another.

The operation of the arcless fuse 21 of this construction will now be described.

The fuse element 25, molded in the housing 27 of the amorphous solid, is normally in a solid state. Any other element than the fuse element 25 exists in the housing 27.

In this construction, when an excess current develops, Joule heat is generated as is the case with the conventional fuse, so that the fuse element 25 is heated. Because of this heat, the fuse element 25, formed of the low-melting metal, is liquefied.

In the conventional construction, the fuse element 25 is melted at this time, but in this arcless fuse 21, the liquefied fuse element 25 is thermally expanded in a pipe 29 (i.e., a tubular cavity formed as a result of liquefaction of the fuse element 25) sealed in the housing 27.

At this time, an inner surface of the pipe 29 of the housing 27 is subjected to thermal decomposition by heat generated from the fuse element 25, thereby rapidly producing a large amount of gas, and the pressure within the pipe 29 is increased by the metal gas of the fuse element 25 and the thermal decomposition gas. At this time, if the plurality of portions of the fuse element 25 are arranged in closely spaced relation to one another as described above, a stress concentration develops, so that a crack 31 develops in a portion of the inner surface of the pipe 29 on which the stress has concentrated, and at the same time the liquefied, low-melting metal is injected into this crack 31.

As a result of this injection, the amount of the liquefied, low-melting metal in the pipe 29 is reduced, so that an interruption portion 33 is formed in the pipe 29, and as a result the electrical conduction of the fuse element 25 is interrupted. At this time, an arc resistance is increased by the pressure effect and the change of the electrically-conductive gas into a lean state, and also the cooling effect is achieved, so that an arc discharge is interrupted.

Thus, in the above arcless fuse 21, the fuse element 25 is formed into such a non-linear configuration that the plurality of portions are arranged in closely spaced relation to one another, and this fuse element is molded in the housing 27, and therefore the crack 31 can be formed by the pressure within the pipe 29 which pressure is increased by the liquefaction of the fuse element 25, and the low-melting metal is injected into this crack 31. By doing so, the conduction of the fuse element 25 can be interrupted without producing an arc discharge. As a result, a malfunction of a computer or the like due to an abrupt voltage change, developing at the time of an arc discharge, is prevented.

In addition, since the liquefied, low-melting metal is injected into the crack 31 formed in the housing 27, damage of a glass tube (as encountered in the conventional fuse) due to the dissipation of the low-melting metal is prevented.

Furthermore, since the housing 27 is made of the amorphous solid, a trace of the crack 31 clearly remains, and therefore whether or not the melting has been effected can be easily visually confirmed.

In this arcless fuse 21, by changing the material and configuration of the fuse element 25, the fuse, meeting with various environments (melting condition, visual confirmation and so on), can be provided.

In the above embodiment, the fuse element 25 is formed into the non-linear shape, and the crack 31 is formed by the stress concentration. However, for example, there may be used an arrangement in which a cavity is beforehand formed in the vicinity of the pipe 29, and a partition wall, separating this cavity and the pipe 29 from each other, is defined by a weak portion, and the crack 31 is formed in this partition wall, thereby injecting the low-melting metal into this cavity.

In this construction in which the cavity is formed, the low-melting metal can be more positively injected, and besides the melting can be more easily visually confirmed by judging from the injection of the metal into the cavity.

As described above in detail, in the arcless fuse of the present invention, the fuse element is formed in such a non-linear configuration that the plurality of portions are arranged in closely spaced relation to one another, and the fuse element is molded in the housing. Therefore, when the pressure within the tubular cavity increases as a result of liquefaction of the fuse element, a crack is formed in the inner surface of the tubular cavity by the concentration of the stress, and the liquefied fuse element is injected into this crack, thereby interrupting the electrical conduction of the fuse element. At this time, an arc resistance is increased by the pressure effect and the change of the electrically-conductive gas into a lean state, and also the cooling effect is achieved, so that an arc discharge is interrupted. Furthermore, since the liquefied, low-melting metal is injected into the crack, damage of a glass tube or the like due to the dissipation of the liquefied, low-melting metal can be prevented.

In the arcless fuse having the housing made of the amorphous resin, the housing is softened without exhibiting a constant melting point, and therefore the crack remains in such a condition that it can be easily viewed, and therefore the melting can be easily visually confirmed.

What is claimed is:

1. An arcless fuse comprising a fuse element having opposite ends connected respectively to a pair of terminals, said fuse element being in the form of one of a wire and a strip;

wherein a part of said fuse element intermediate the opposite ends thereof has a non-linear configuration such that a plurality of portions of said part are arranged in closely spaced relation to one another;

and said fuse element is embedded in a molded synthetic resin housings, said synthetic resin comprising an amorphous solid.

2. An arcless fuse according to claim 1, in which said housing is provided with a cavity which is formed in the vicinity of said part of said fuse element.

3. An arcless fuse according to claim 1, in which said fuse element is molded in such a manner that a tubular cavity is formed as a result of liquefaction of said fuse element when said fuse element is subjected to an excess current.

* * * * *